United States Patent [19]

Fenwick

[11] Patent Number: 4,894,876

[45] Date of Patent: Jan. 23, 1990

[54] MULTIPURPOSE MATERNITY CARE BED

[75] Inventor: Loel Fenwick, Spokane, Wash.

[73] Assignee: Hill-Rom Company, Inc., Batesville, Ind.

[21] Appl. No.: 220,029

[22] Filed: Jul. 15, 1988

[51] Int. Cl.[4] ..... A61G 7/00

[52] U.S. Cl. ..... 5/60; 5/66; 5/69

[58] Field of Search ..... 5/60–69; 269/322–325

[56] References Cited

U.S. PATENT DOCUMENTS

| | | | |
|---|---|---|---|
| 2,021,107 | 11/1935 | Logif | 269/322 |
| 2,120,732 | 6/1938 | Comper et al. | 269/323 |
| 2,257,491 | 9/1941 | Armstrong | 269/322 |
| 2,290,191 | 7/1942 | Karlson | 269/322 |
| 2,306,031 | 12/1942 | Anderson et al. | 269/323 |
| 2,832,655 | 4/1958 | Adolphson | 269/322 |
| 3,281,141 | 10/1966 | Smiley et al. . | |
| 3,318,596 | 5/1967 | Herzog | 5/68 |
| 3,334,951 | 8/1967 | Douglass, Jr. et al. | 269/324 |
| 3,851,870 | 12/1974 | Cook | 269/322 |
| 4,034,972 | 7/1977 | Peterson | 269/322 |
| 4,057,240 | 11/1977 | Damico et al. . | |
| 4,139,917 | 2/1979 | Fenwick . | |
| 4,227,269 | 10/1980 | Johnston | 5/68 |
| 4,247,091 | 1/1981 | Glowalki et al. . | |
| 4,411,035 | 10/1983 | Fenwick . | |
| 4,426,071 | 1/1984 | Klevstad | 269/325 |
| 4,639,954 | 2/1987 | Speed | 5/63 |
| 4,682,376 | 7/1987 | Feldt | 5/60 |
| 4,751,754 | 6/1988 | Bailey et al. | 5/69 |
| 4,805,249 | 2/1989 | Usman et al. | 5/60 |
| 4,821,350 | 4/1989 | Feldt | 5/60 |

FOREIGN PATENT DOCUMENTS

| | | | |
|---|---|---|---|
| 636085 | 1/1928 | France . | |
| 1456058 | 9/1966 | France . | |
| 5881032 | 5/1983 | Japan | 269/323 |
| 497662 | 12/1938 | United Kingdom . | |
| 1389344 | 4/1975 | United Kingdom . | |

OTHER PUBLICATIONS

The Borning Corporation Brochure, "Borning's New 650 H-R Chair/Childbearing Bed . . . The Complete System for Low-and High-Risk Childbirth", 1982.

The Borning Corporation Brochure, "Borning 650 High/Low".

Borning Corporation Brochure, "Genesis—Giving You The Winning Edge in The New Obstetrics!", 1985.

Borning Corporation Brochure, "Genesis—The New Generation All-Risk OB Management System From the World Leader", 1984.

Borning Brochure, "Genesis—User Guide".

Borning Corporation, "Genesis LDR and LDRP—Two New Genesis Beds for Single-Room Maternity Care", 1986.

*Primary Examiner*—Gary L. Smith
*Assistant Examiner*—Eric K. Nicholson
*Attorney, Agent, or Firm*—Wells, St. John & Roberts

[57] ABSTRACT

A bed for multipurpose maternity care uses includes an elevationally adjustable bed frame carried by transversely spaced lift mechanisms that permit the bed frame to nest between the lift mechanisms as it is raised or lowered with respect to a supporting base. An upper mattress assembly, including a seat and back rest, are pivotally mounted across the top of the bed frame. The bed frame includes a forwardly open cavity having guides for receiving a longitudinally movable lower mattress assembly at all elevational positions of the bed frame relative to the base. Elevationally movable outer supports mounted on the bed frame engage and support the lower mattress assembly when it is extended longitudinally outward from the bed frame. A pair of foot supports are movably mounted on brackets alongside the bed frame. The supporting linkages and brackets for the foot supports can be selectively connected to the outer supports for moving the extended lower mattress assembly in unison with the foot supports. The lower mattress assembly can be retracted under the seat regardless of the angular or elevational position of the seat relative to the base of the bed.

29 Claims, 14 Drawing Sheets

12
23
26
27
28
55
19
21
13
10
30
19
15
77
14
25
11
40
45
47
42
42
40
42

23
12
27
28
22
55
60
67
16
15
10
78
31
60
15
25
14
77
78
11
48
40
45
47
42
40
42
42

MULTIPURPOSE MATERNITY CARE BED

TECHNICAL FIELD

This disclosure pertains to hospital beds, and specifically to multipurpose maternity beds for meeting the requirements of a mother before, during and after childbirth.

BACKGROUND OF THE INVENTION

The present invention constitutes an improvement in the development of combination labor, delivery and patient care beds. U.S. Pat. No. 4,139,917, issued on Feb. 20, 1979 shows a bed that includes a removable lower mattress section which can be rolled about the floor on independent casters. Various positions of the bed are illustrated in the patent to show its ability to serve as a patient care bed or operational chair during birthing procedures. While this bed has been commercially successful, its use requires accommodation to use of a separable mattress unit that requires storage space when not being utilized by the patient or by attending personnel.

A subsequent bed design is shown in U.S. Pat. No. 4,411,035, which was issued Oct. 25, 1983. In this bed, which has been produced and sold by the Borning Corporation of Spokane, Washington as the 650H-R (TM) Birth Chair/Child Bearing Bed, the lower mattress assembly is partially retractable under the seat when the seat is in a raised position. The retractable feature solves the problem of accommodating a separable bed assembly, but the prior mechanism dictates first raising the seat before retracting the foot section of the bed. This limits the bed positions in which the retractable feature can be utilized.

Another bed, introduced by the Borning Corporation as the Genesis (TM) Multipurpose Birthing Bed, provides an elevationally adjustable lower mattress assembly that can be lifted from the unit and removed when not desired. While much smaller than the separable foot section of the bed shown in U.S. Pat. No. 4,139,917, this removable section again requires external storage space.

The present invention has been designated to provide total versatility to the lower mattress assembly. It is not only removable, as in the Genesis (TM) unit, but can be recessed under the seat of the upper mattress assembly regardless of the seat position or the elevation of the bed with respect to the supporting floor. This has been accomplished by a combination of a novel nesting lift apparatus for the bed frame and novel outer supports that carry the lower mattress assembly while extended from the bed frame. The option of utilizing foot supports in place of, or in conjunction with the lower mattress assembly is provided by the outer supports movably mounted on the bed frame for powered elevational adjustment as required. The outer supports can be connected to powered brackets which carry elevational adjustable leg or foot supports. The extended lower mattress assembly is adapted to "piggyback" the brackets for the foot supports for powered elevational adjustment of the lower mattress. The lower mattress assembly can also be manually raised or lowered relative to the bed frame independently of the elevational position of the foot supports. The entire bed can also be shifted to a critical care mode, or Trendelenburg position, when this is desired. The result is an extremely versatile bed/chair for maternity and gynecological procedures.

BRIEF DESCRIPTION OF THE DRAWINGS

The preferred embodiment of the invention is illustrated in the accompanying drawings, in which:

FIG. 6 is a top view of the bed as seen in FIG. 5, with the mattress sections shown in the upper half of the view, the mattress sections being removed in the lower half and portions of the sheet metal covers being broken away;

FIG. 7 is a view similar to FIG. 6, showing the lower mattress assembly in a retracted position;

FIG. 13 is a view similar to FIG. 11 showing the opposite side of the bed; and FIG. 14 is a view similar to FIG. 12, showing the opposite side of the bed.

DETAILED DESCRIPTION OF THE PREFERRED EMBODIMENT

Figure 1:
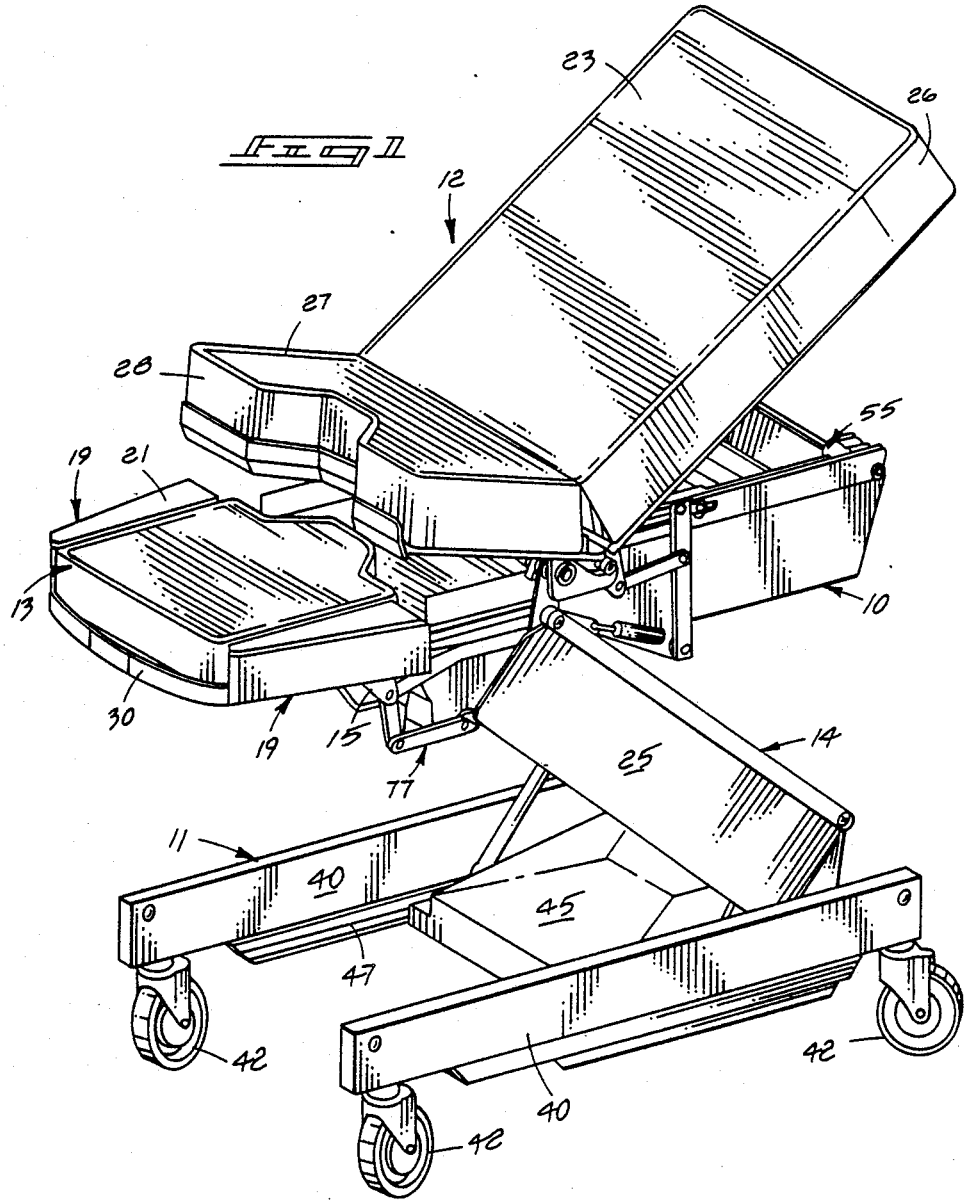
FIG. 1 is a perspective view of the bed in an elevated position, with the seat and backrest raised.

The following disclosure of the invention is submitted in compliance with the constitutional purpose of the Patent Laws "to promote the progress of science and useful arts" (Article 1, Section 8).

To serve as positional references throughout this disclosure, the bed shall be described as being "longitudinal" along its length and as being "transverse" across its width. The longitudinal end of the bed shown to the right in FIG. 1 shall be termed its "head end", "rear end" or "upper end". It would typically be provided with a fixed headboard to present the normal appearance of a bed, particularly when the mattress assemblies of the bed are aligned in a horizontal, coplanar configuration. The headboard (not shown) can be removable when the bed elements are positioned in a chair configuration. The longitudinal end of the bed shown at the left in FIG. 1 shall be termed its "foot end", "front end" or "lower end". The terms "rear" and "front" shall be used only in a relative sense to assist in understanding the features and positions of the various elements. Since the bed is a floor-supported structure, it is designed to be normally utilized in an upright position with exposed upper mattress surfaces on which the body of a user is supported.

The following description relates to the bed shown in the drawings, which permits storage, extension, or removal of a lower mattress assembly at all elevational positions of the bed. This versatility is accomplished by nesting the bed frame within transversely spaced lift mechanisms that elevationally adjust the height of the bed, by providing a guide arrangement on the bed frame for supporting the lower mattress assembly in a retracted storage position beneath the upper mattress assembly, by outer supports for holding the lower mattress assembly in an extended cantilevered position, and by features that permit physical release and removal of the lower mattress assembly from the bed when this is desired.

Referring to FIGS. 1–5, a rigid bed frame 10 is carried on a floor-supported base 11 by transversely spaced adjustable lift assemblies 14. The lift assemblies 14 are parallelogram mechanisms operably connected between the bed frame 10 and the base 11 for elevationally raising or lowering bed frame 10 relative to base 11. The lift assemblies 14 are covered from view by sheet metal plates 25 that move with them. The plates 25 are removed in FIGS. 8 and 9.

A longitudinal upper mattress assembly 12 is positioned on the rigid bed frame 10, overlying the bed frame 10 and movably mounted to it. Upper mattress assembly 12 is adapted to be engaged by the head and torso of a user. It includes a pivotable backrest 23 and seat 27

A separate lower mattress assembly 13, including a rigid tray 30, is movably supported on the bed frame 10. It is adapted to be engaged by the lower extremities of a user. The lower mattress assembly 13 is longitudinally retractable into a longitudinal cavity open toward the front of the bed frame 10 and beneath the upper mattress assembly 12 for storage purposes. When cantilevered and extended outwardly from the bed frame 10, the lower mattress assembly 13 is elevationally adjustable between positions coplanar with the upper mattress assembly 12 and lowered positions that better accommodate certain sitting positions of a user.

Figure 4:
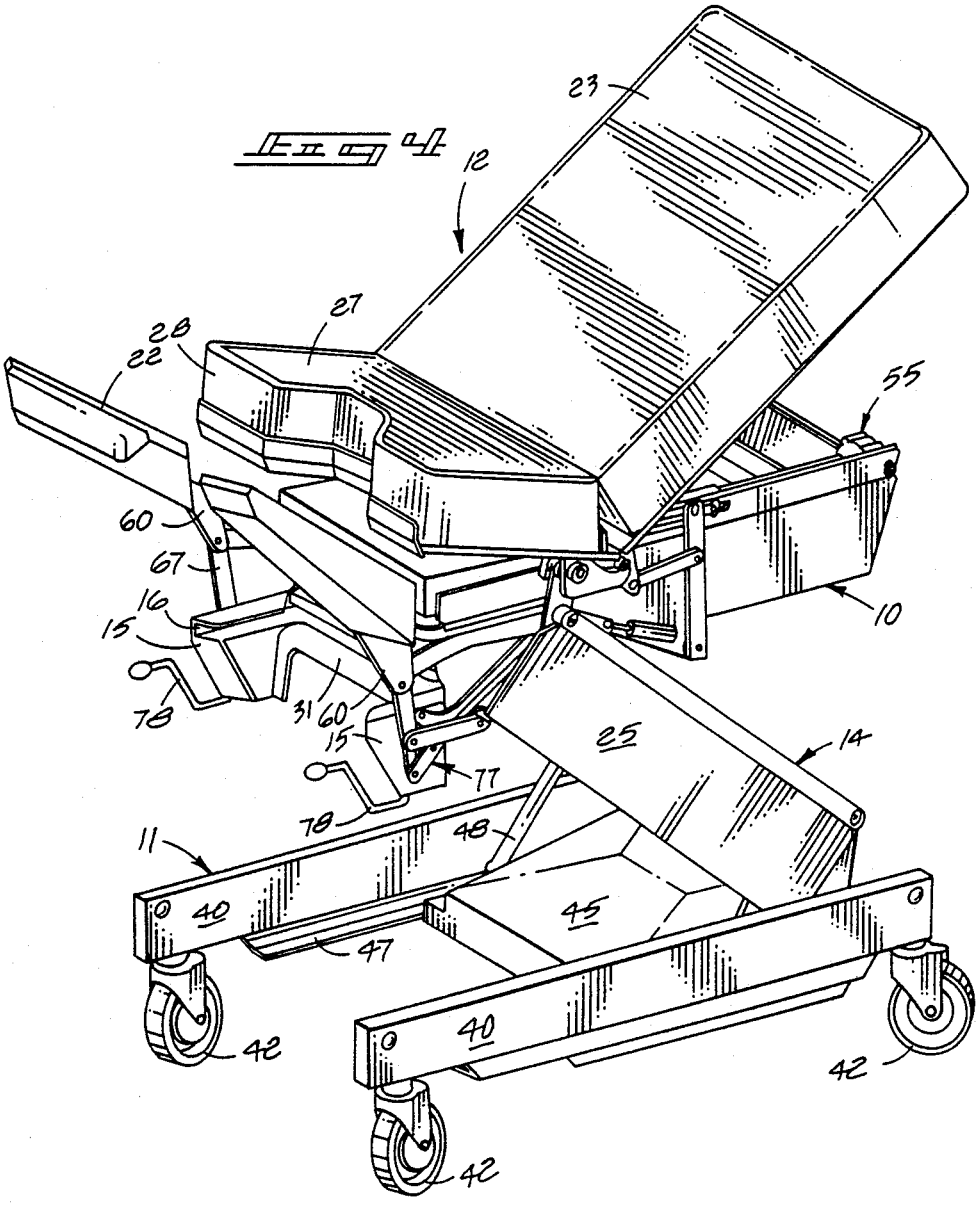
FIG. 4 is a view of the elevated bed with the seat and backrest raised, the lower mattress stored, and the foot supports extended.

A pair of outer supports 15 are mounted to bed frame 10 at its front end (see FIG. 4). Outer supports 15 include opposed inwardly-facing slotted guides 16 for securing the lower mattress assembly 13 in a cantilevered position extending longitudinally outward from the bed frame 10 as shown in FIG. 1. The outer supports 15 are selectively engageable by lower mattress assembly 13 to lock it into this extended position as it is extended outwardly from a retracted position with the bed frame 10. Guides 16 also slidably support the tray for lower mattress assembly 13 as it is moved into or out from the receiving cavity of bed frame 10.

Many different features could be used to lock the lower mattress assembly 13 between the outer supports 15 while in its cantilevered position protruding outwardly from bed frame 10. One effective lock for this purpose comprises complementary tapered surfaces along the rear side surfaces of the tray 30 and within the guides 16. The transverse tapers limit the outward longitudinal movement of tray 30 relative to the outer supports 15 and permit the tray 30 to wedge into place on the outer supports 15 in a rigid fashion. Other forms of mechanical locks that can be manually released can be substituted for this purpose.

The lower mattress assembly 13 is completely removable from the bed when this is desired. Removal can be accomplished by releasing the mechanical interlocks between the tray 30 and outer supports 15. If complementary tapered surfaces are used in the manner just described, removal of tray 30 can be accomplished by first removing the mattress or pad from tray 30 while it is in its cantilevered position. The empty tray 30 can then be retracted into the cavity at the interior of bed frame 10, where its front edge can be raised above the guides 36 and lifted forwardly from the bed frame interior for storage purposes.

Figure 2:
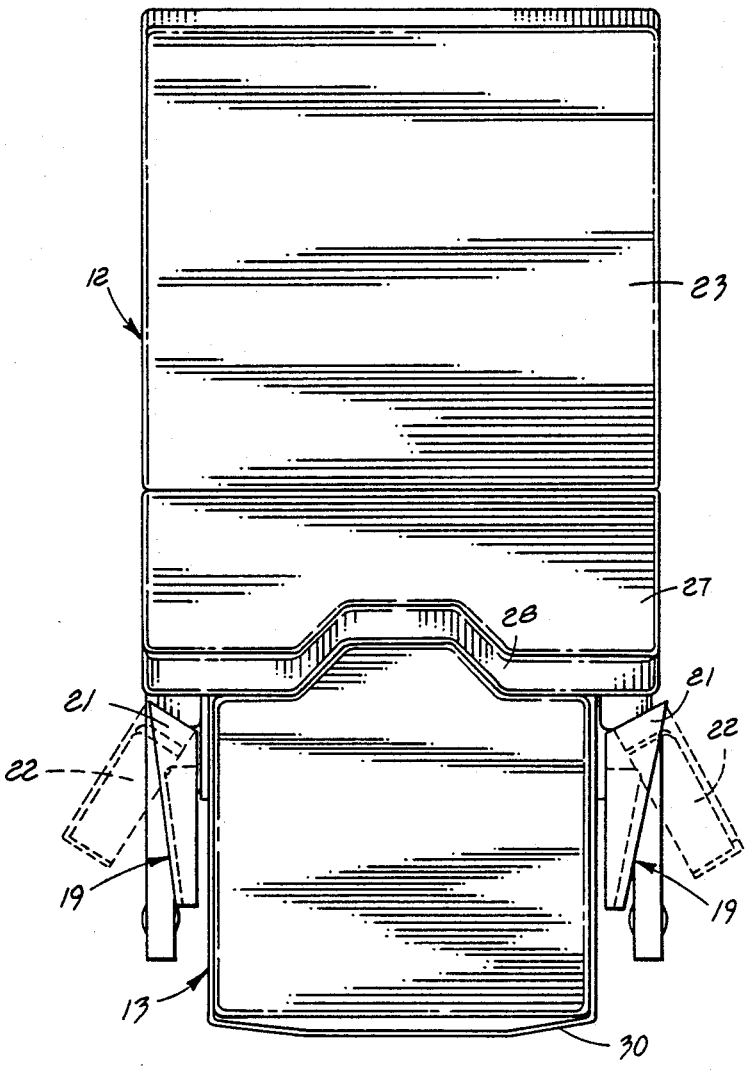
FIG. 2 is a top view of the bed as seen in FIG. 1.

The width of the upper mattress assembly 12 extends transversely beyond the side walls of bed frame 10, causing the side edges of the upper mattress assembly 12 to transversely overlap the lift assembly 14 at each side of the bed frame 10. Conversely, the width of the lower mattress assembly 13 must be less than the separation between the side walls 22 at the sides of the cavity formed within bed frame 10. As can be seen in FIG. 2, the transverse width of the lower mattress assembly 13 is less than that of the upper mattress assembly 12.

When the mattress assemblies 12 and 13 are coplanar (FIG. 5), the differences in their transverse widths is accommodated by dual purpose foot supports 19, which are designed to be engaged by the feet of one on the upper mattress assembly 12. The illustrated foot supports 19 each include a longitudinally tapered surface 21 at one side. When extended longitudinally alongside the lower mattress assembly 13, the surfaces 21 merge the widths of the upper and lower mattress assemblies 12 and 13. Each support 19 also includes a recessed foot support surface 22 along a second side for engagement by the foot of a person on the upper mattress assembly 12 after the foot support 19 has been pivoted to an upwardly tilted or raised position (FIG. 4).

Figure 10:
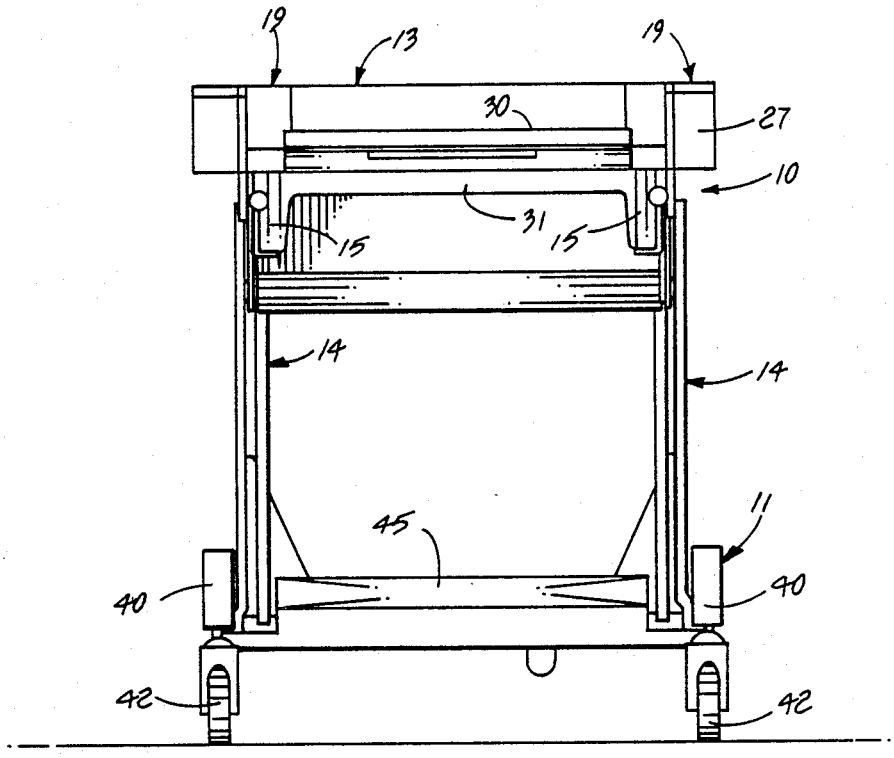
FIG. 10 is a front elevation view of the bed as shown in FIG. 5.
Figure 11:
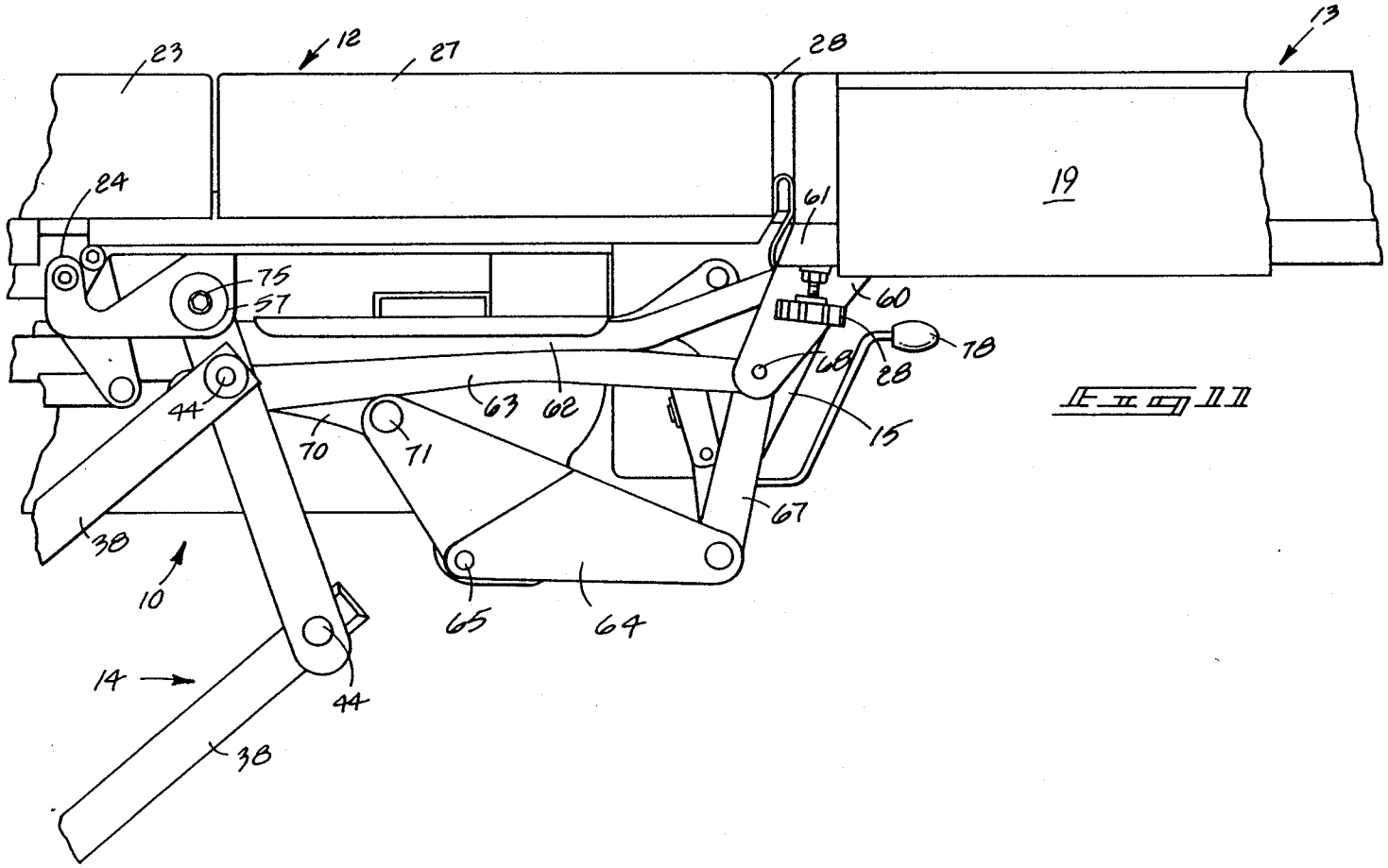

One key to the versatility of this bed is the fact that the lift assembly 14 does not impede elevational adjustment and longitudinal movement of the lower mattress assembly 13 throughout the full range of elevational movement imparted to bed frame 10 by operation of the lift assembly 14. This is achieved by locating the lift assemblies 14 outwardly adjacent to the respective sides of the bed frame 10 (see FIG. 10). The sides of the bed frame 10 are partially overlapped by the lift assembly 14 in a nesting relationship that permits bed frame 10 to move elevationally within the space bounded by the lift assemblies 14. This nesting relationship is to be contrasted with conventional lifting mechanisms for adjustable beds, which typically comprise pivoted arms or extendible pedestals positioned under the bed frame, rather than at its respective sides.

FIGS. 1, 3, 4 and 5 illustrate several possible positions of the bed. They are not exhaustive, since additional configurations will be understood from the following description. For instance, when the mattress assemblies are coplanar (FIG. 5), the head end of the bed can be tilted downwardly into a Trendelenburg position, in which the mattress assemblies remain coplanar, but the head end of the bed is lower than the foot end.

Figure 8B:
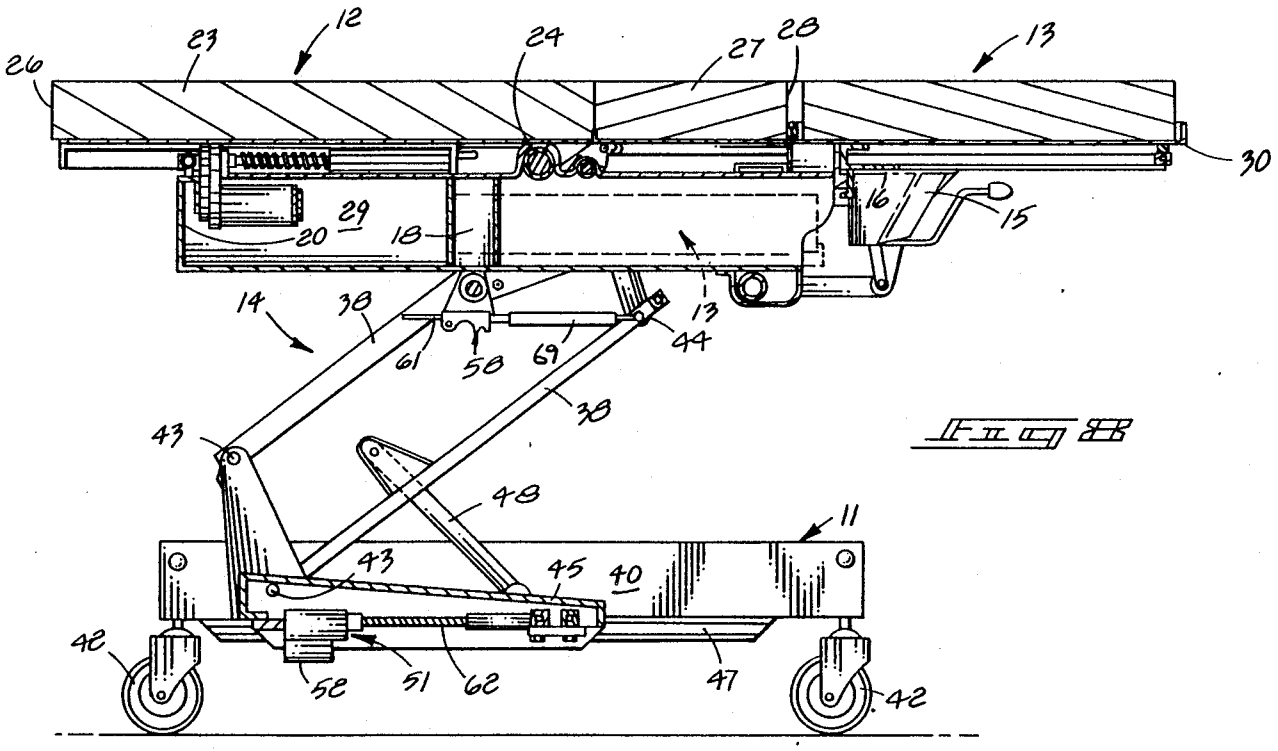
FIG. 8 is a longitudinal vertical sectional view taken through the center of the bed in the position shown in FIG. 5.
Figure 9:
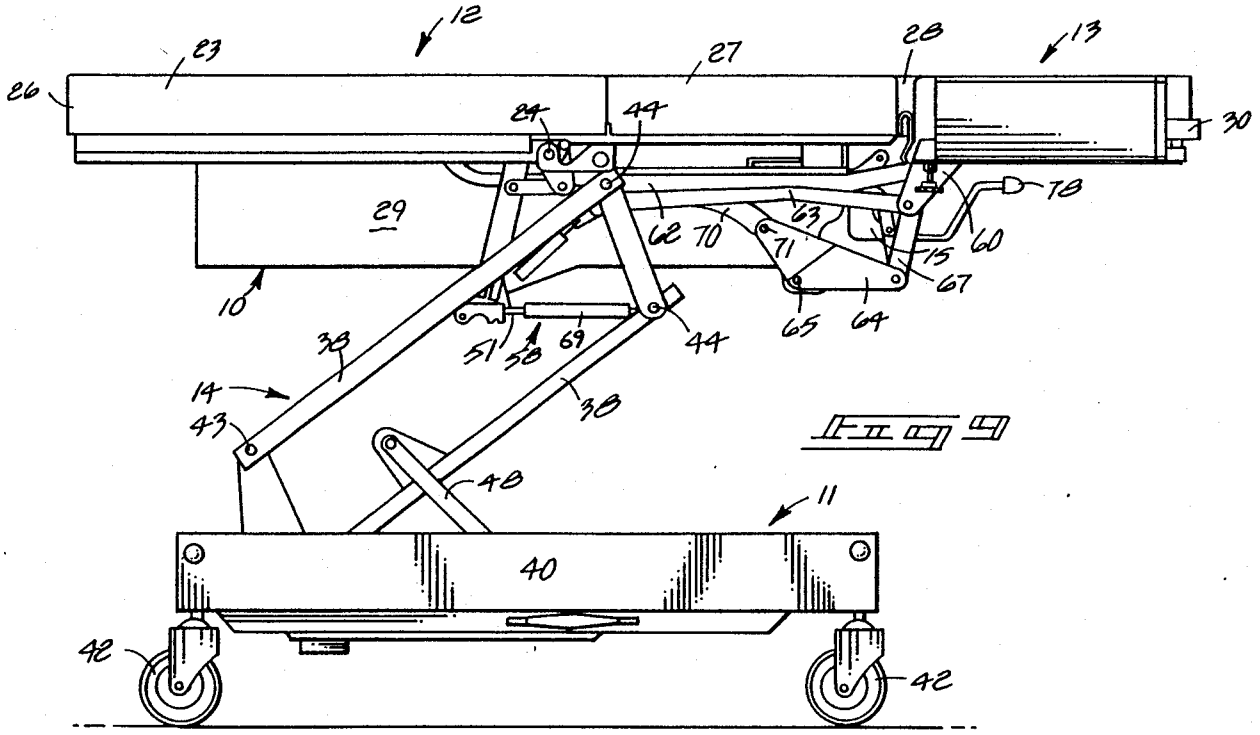
FIG. 9 is a side elevation view of the bed as shown in FIG 5.

The details of the lift assembly 14 can best be understood by viewing FIGS. 8 and 9. The lift assembly 14 includes a pair of separate elevating mechanisms positioned alongside the respective sides of the bed frame 10. These are each shown as including upper and lower parallel arms 38, which extend from elevationally spaced lower transverse pivot connections 43 on a movable base transport 45 to upper transverse pivot connections 44.

The bed frame 10 is pivotally suspended by means of a cross shaft 57 at one of the upper pivot connections 44 on arms 38 at each side of the bed. Shaft 57 serves as the primary structural member carrying the weight of the mattress assemblies and associated mechanisms on the bed frame 10. The angular position of the bed frame 10 about shaft 57 relative to base 11 is governed by adjustable linkages 58 that can include a gas cylinder 69 and extendible piston rod 61 connected between the remaining upper pivot connection 44 on arms 38 and the underside of bed frame 10 (see FIG. 8). While the cylinder 69 will normally be set to maintain bed frame 10 in a horizontal position, it can be actuated to permit extension of piston rod 61, allowing the head end 26 of the aligned upper and lower mattress assemblies 12 and 13 to be pushed downwardly by manual pressure. This will tilt them about the axis of shaft 57 into a Trendelenburg position. When subsequently actuated, gas cylinder 69 can either assist return manual positioning of the mattress assemblies or can move the mattress assemblies back to their normal horizontal orientation.

Base 11 essentially comprises a pair of horizontal longitudinal rails 40 connected by transverse braces in an H-shaped plan configuration. Rails 40 are floor-supported through conventional casters 42, which facilitate movement of the bed. The inner surfaces of rails 40 are provided with longitudinal tracks or guides 47 within which the base transport 45 of the lift assembly 14 is guided. Each lift assembly 14 is completed by a crank arm 48 that serves as a pivotal restraint connected between a rail 40 and one arm 38. The crank arms 48 partially restrain movement of arms 38 in response to longitudinal movement of base transport 45 to define their angular relationships relative to the base 11.

Elevational adjustment of bed frame 10 is controlled through a first motorized actuating assembly 51, which is shown on the base 11. The actuating assembly 51 essentially comprises a motor 52 and a powered screw 62 operably connected to the common base transport 45 for the lower pivot connections 43 of parallel arms 38. The screw propels base transport 45 along guides 47. This translational movement imparted by the motor 52 is converted to elevational movement of bed frame 10 relative to base 11 as arms 38 pivot in response to the forces exerted on them by the restraining crank arms 48.

Figure 3:
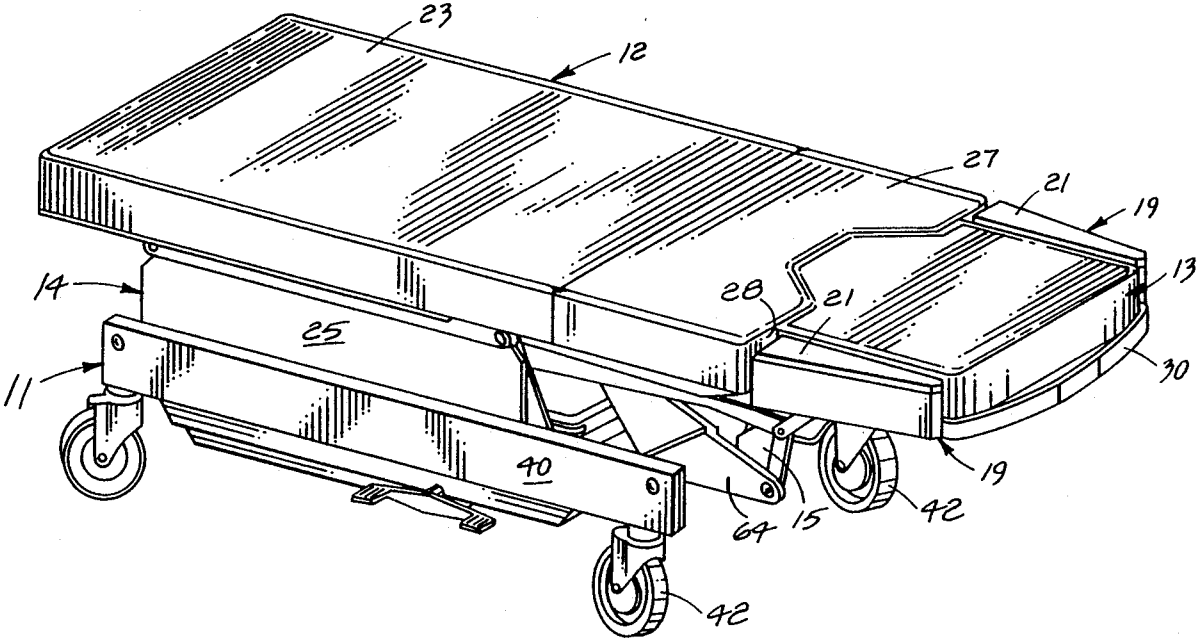
FIG. 3 is a perspective view of the bed in a lowered position with the mattresses coplanar.
Figure 5:
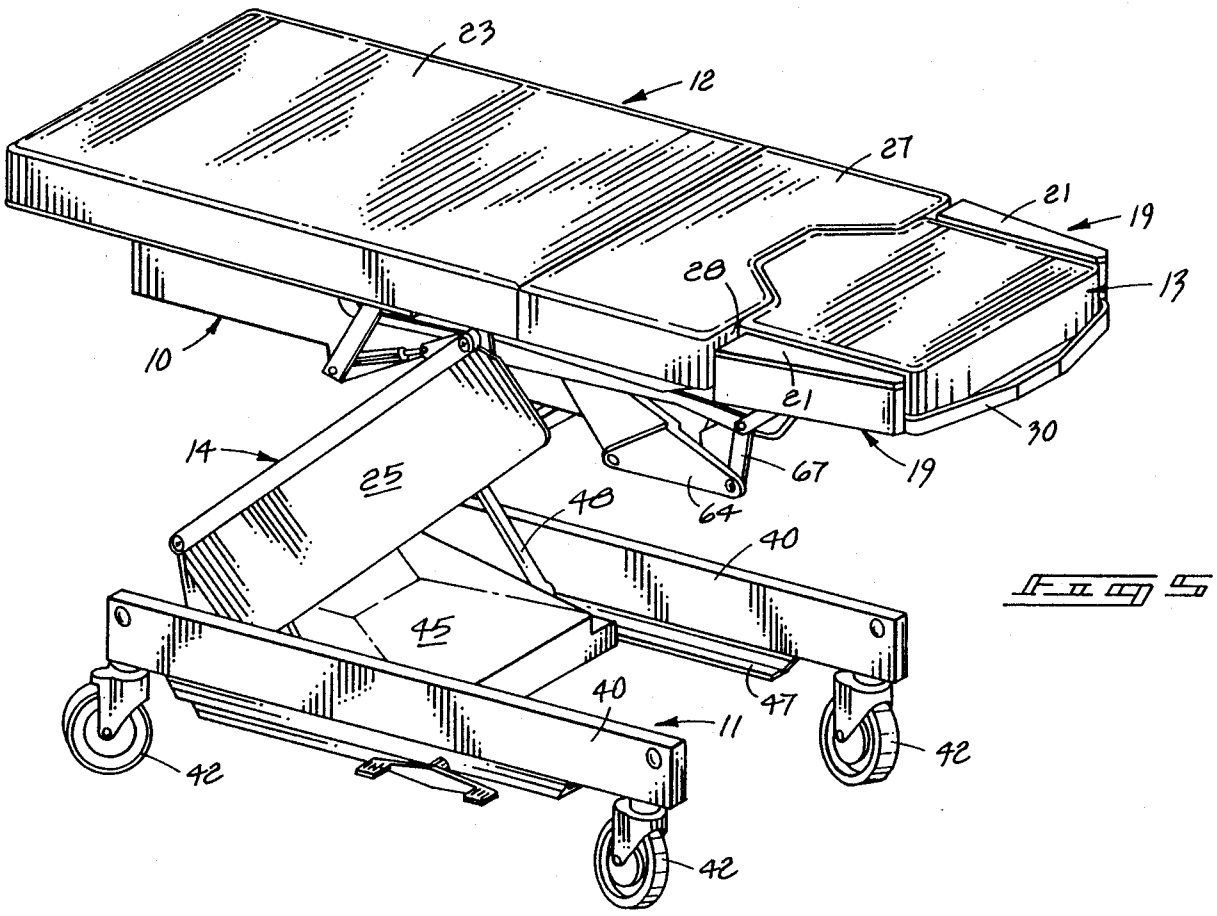
FIG. 5 is a perspective view of the elevated bed with the mattresses coplanar.
Figure 5:
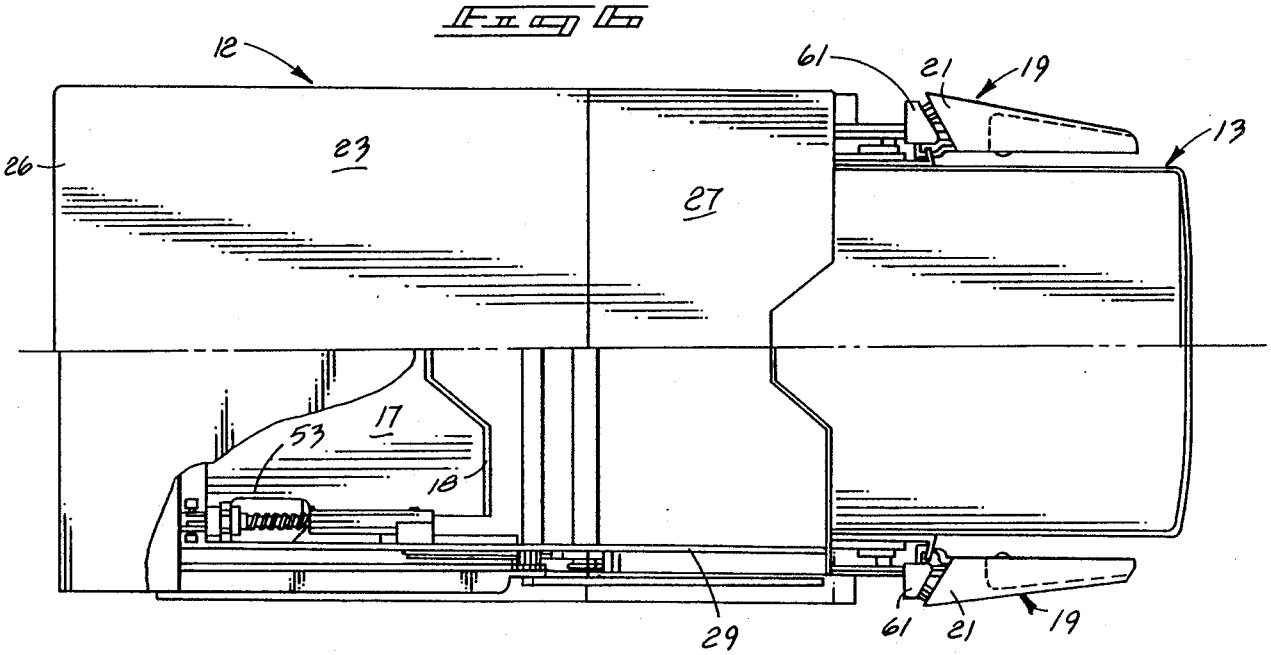

FIGS. 3 and 5 illustrate the basic coplanar orientation of the upper and lower mattress assemblies 12, 13, with the foot supports 19 positioned adjacent to the sides of the lower mattress assembly 13. FIG. 1 shows a configuration where the lower mattress assembly 13 and foot supports 19 remain in their normal cantilevered positions, but the upper mattress assembly 12 is moved to a seat or chair configuration, with both backrest 23 and seat 27 pivoted oppositely to one another. This positions the front edge of the seat 27 elevationally above the lower mattress assembly 13. The position shown in FIG. 1 might be used by a seated person resting the feet on the upper surface of lower mattress assembly 13. It also might be an intermediate transition to the configuration shown in FIG. 4, where the lower mattress assembly 13 is retracted under the seat 27 and the foot supports 19 are pivoted outwardly relative the outer supports 15 to serve as spaced footrests for a person seated on the upper mattress assembly 12. The mattress configurations shown in FIGS. 1, 3, 4 and 5 can be achieved at any elevation of the bed structure by proper actuation of the supporting lift assemblies 14.

The bed frame 10 can best be viewed in FIGS. 6–9. It preferably includes a solid rectangular floor 17 bounded by transversely spaced vertical side walls 29 and a rear end wall 20. An intermediate inner shield 18 extends transversely over the floor 17 and has a plan configuration that is complementary to the end edge configuration of the lower mattress assembly 13. The three dimensional space between the shield 18, floor 17 and side walls 29 constitutes a forwardly open storage cavity within which lower mattress assembly 13 can be retracted. This storage cavity is unobstructed at the front end of bed frame 10. The floor 17 and the side walls 29 engage and movably guide the lower mattress assembly 13 as it is shifted longitudinally to or from its retracted storage location elevationally under the upper mattress assembly 12 and within the bed frame 10, as shown in dashed lines in FIG. 8.

The bed frame 10 is normally covered by the coplanar backrest 23 and seat 27 of upper mattress assembly 12. They are preferably included in a foldable mattress structure that extends from a head end 26 across the backrest 23 to a front edge 28 across the seat 27. Both the backrest 23 and the seat 27 are pivotally mounted about a transverse axis across the bed frame 10 on a common pivot shaft 24. Backrest 23 is pivotally mounted for permitting its head end 26 to be raised or lowered relative to the bed frame 10. Seat 27 is pivotally mounted for permitting its front edge 28 to be raised or lowered relative to the bed frame 10. Both movements are preferably accomplished simultaneously. The front edge 28 of the illustrated seat 27 is configured to present a V-shaped recess under a seated user, thereby facilitating access to the pelvic area for birthing or gynecological procedures.

The specific structural features of the backrest 23 and seat 27 are not necessary to an understanding of the present invention. Each is comprised of a supporting metal frame covered by a sheet metal panel for surface support of the overlying mattress sections or cushions. They are mechanically connected with respect to pivot shaft 24 so that they pivot in opposite directions about the shaft, the extent of pivotal movement of seat 27 being proportionally less than the pivotal movement of the backrest 23.

The adjustable lower mattress assembly 13 includes a mattress or pad resting on a rigid frame in the form of a tray 30 that can be shifted longitudinally relative to bed frame 10, can be elevationally adjusted while attached to outer supports 15, and can be selectively removed from the bed when required. The rear edge configuration of mattress assembly 13 is complementary to the front edge 28 of seat 27. Thus, when the upper and lower mattress assemblies 12 and 13 are longitudinally aligned in a coplanar configuration at a common elevation, a complete, full-length bed surface is provided to engage and support a user in the normal fashion for reclining or sleeping purposes.

Figure 11:
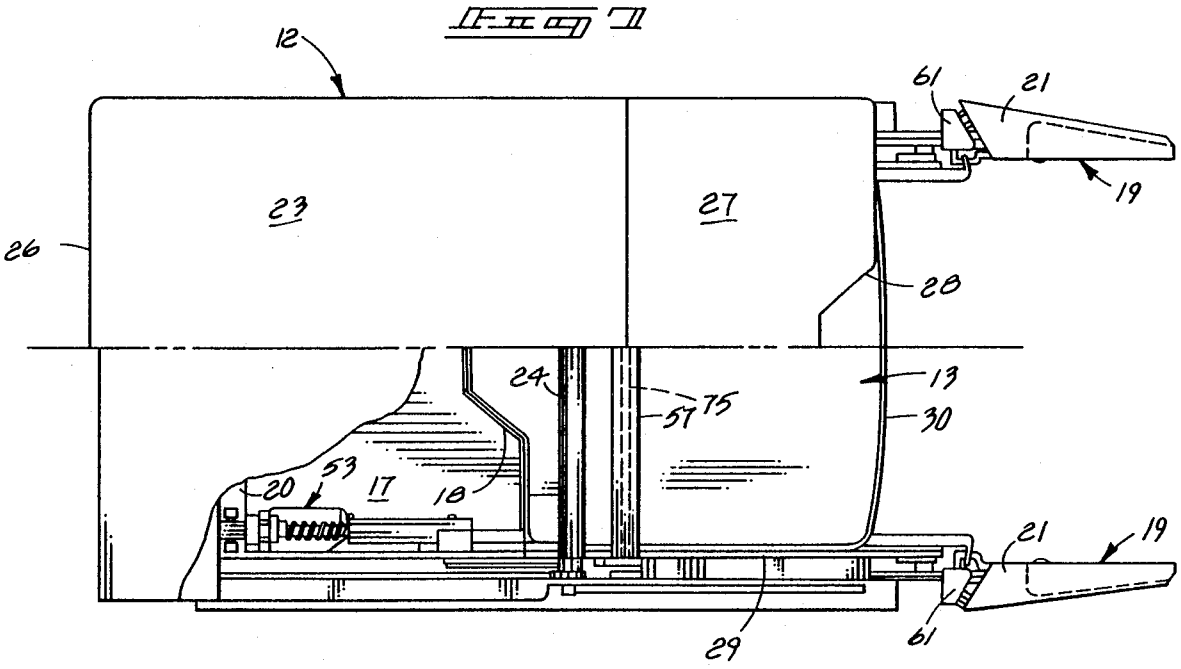
FIG. 11 is an enlarged fragmentary side elevation view of the lower portion of the bed as shown in FIG. 5.
Figure 12:
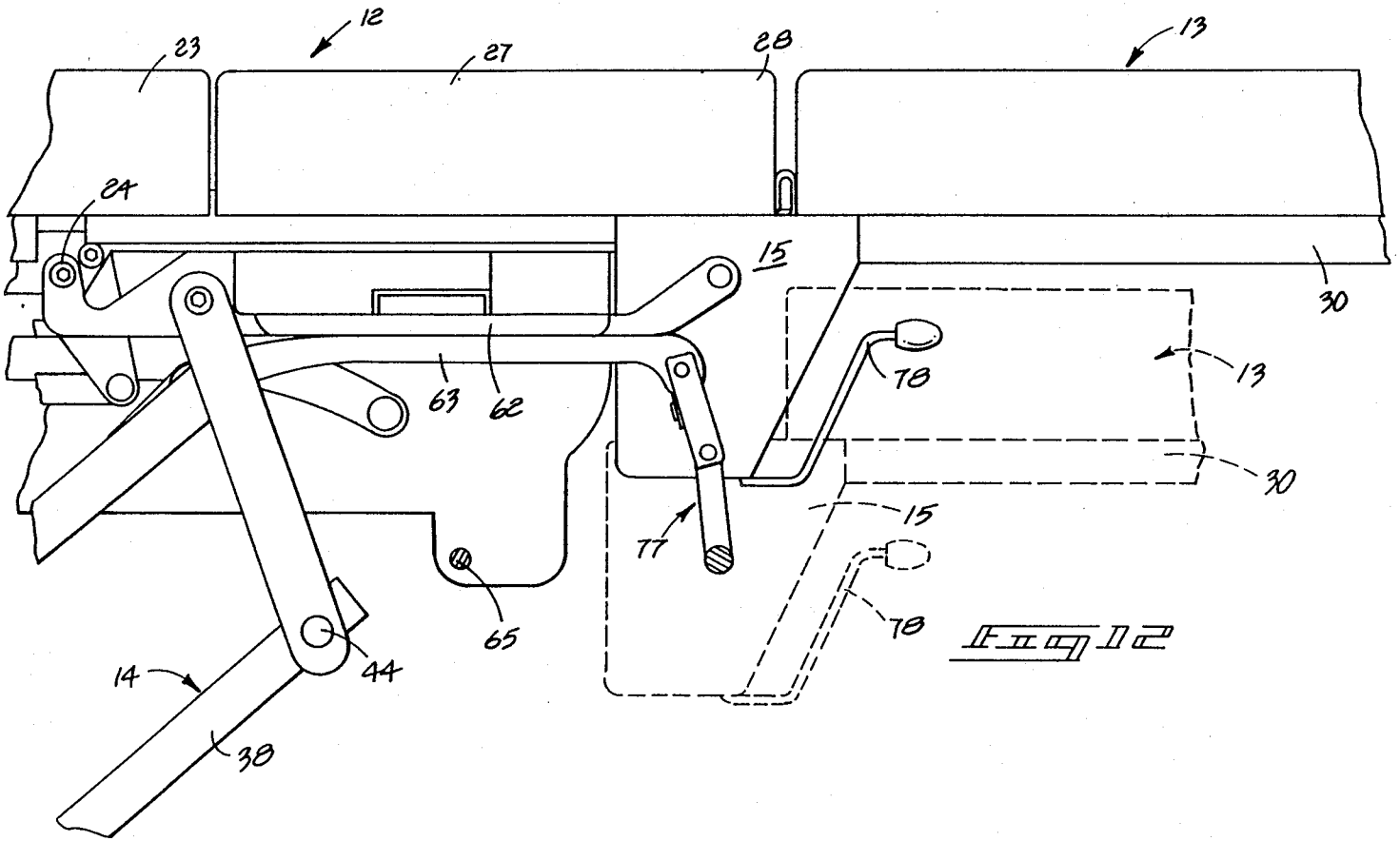
FIG. 12 is a view similar to FIG. 11 showing the underlying support mechanisms at the side of the bed.
Figure 11:
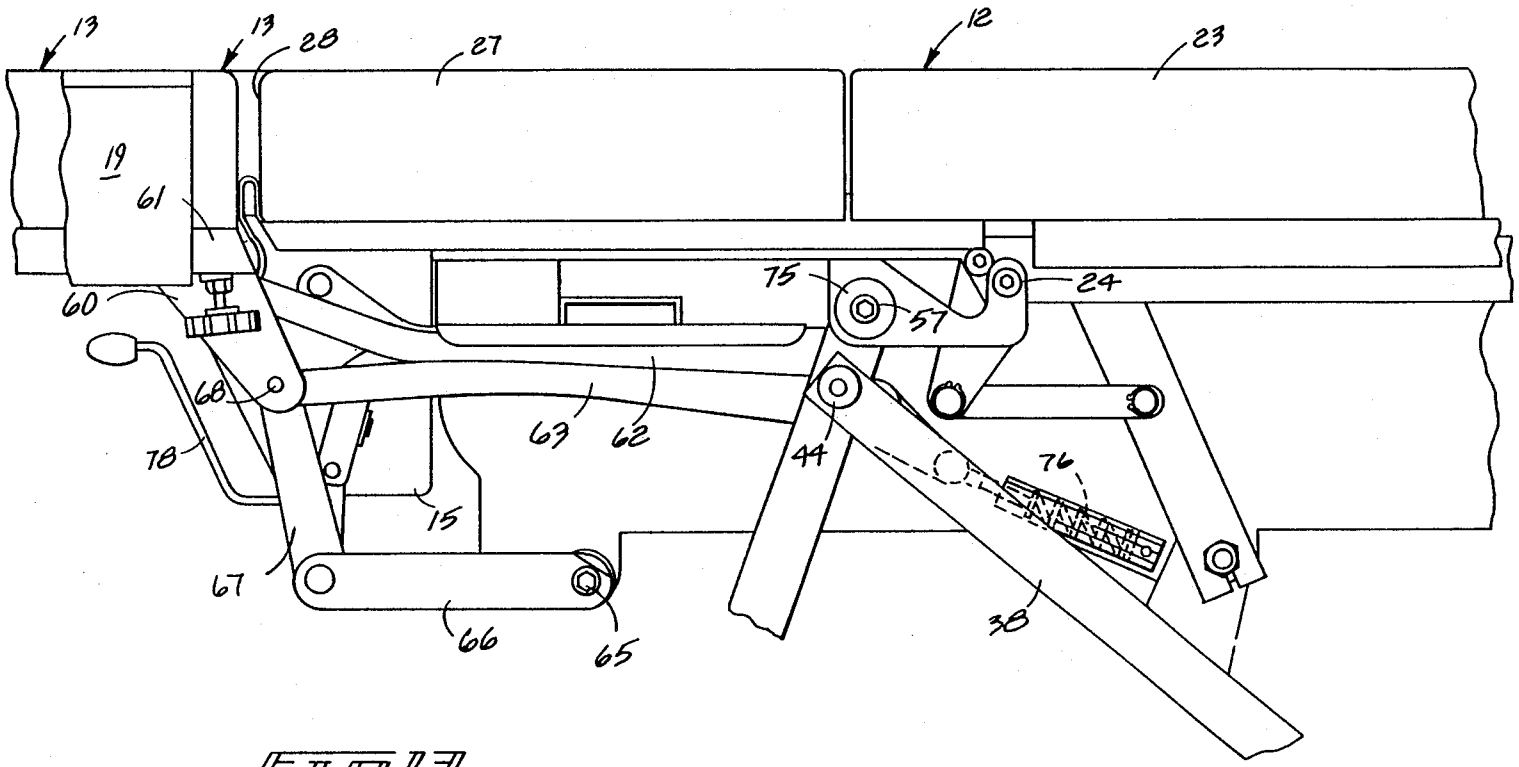
Figure 11:
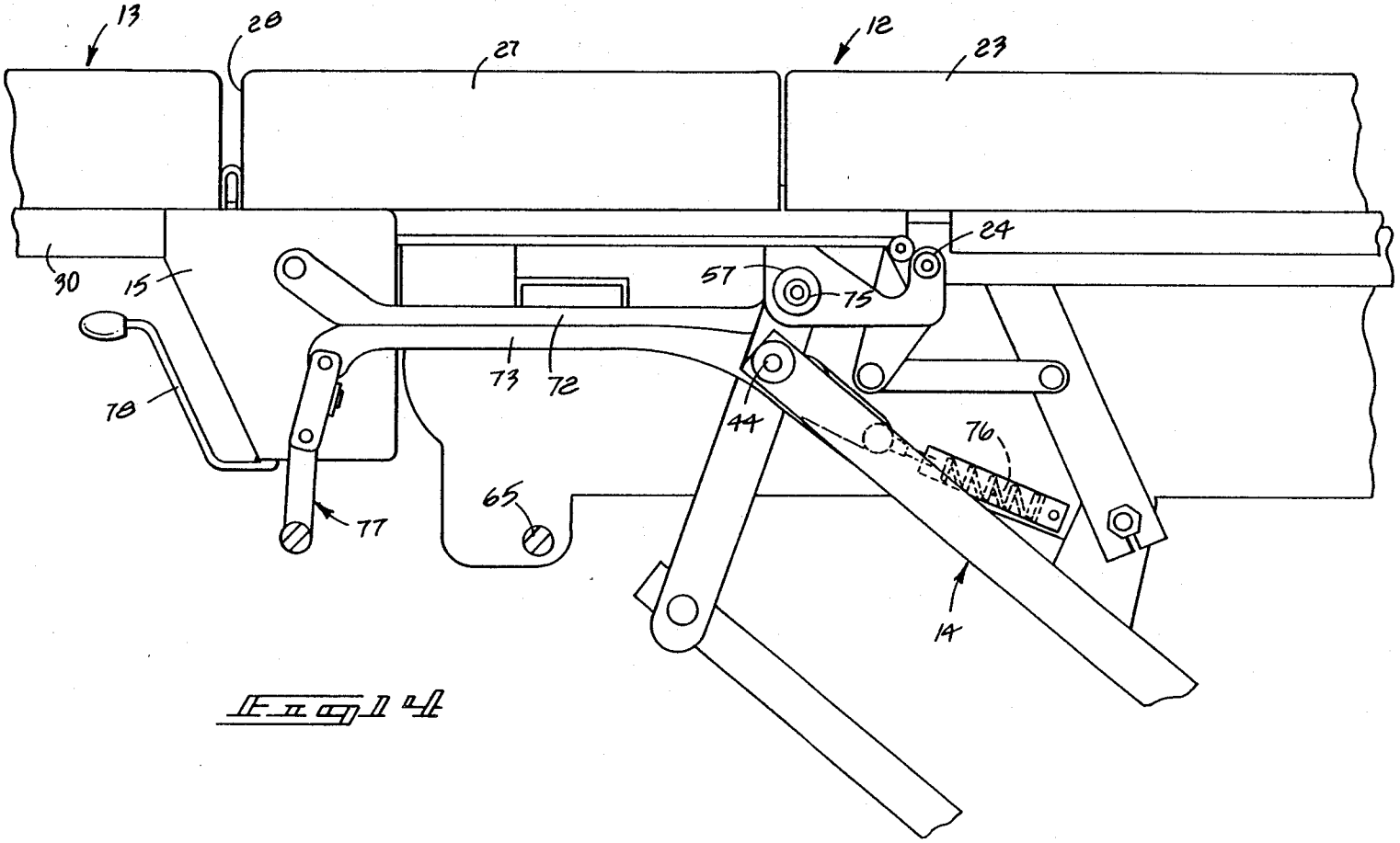

The foot supports 19 are carried on elevationally adjustable brackets 60 located alongside the outer supports 15. The support systems for brackets 60 and outer supports 15 can best be seen in FIGS. 11 through 14. FIGS. 11 and 12 show one side of the bed, while FIGS. 13 and 14 show the opposite side. FIGS. 11 and 13 are exterior views that illustrate the members that elevationally support the-outwardly positioned brackets 60. In FIGS. 12 and 14 the brackets 60 and the elements that directly support them are not shown, so that the underlying elements that carry the outer supports 15 can be viewed.

Each bracket 60 includes a receiving socket 61 that pivotally supports an angularly offset stub shaft that protrudes rearwardly from each foot support 19. Suitable detent mechanisms are provided within socket 61 to yieldably hold the foot supports 19 with the one side 21 facing upwardly or its second side 22 facing upwardly, depending upon the operational function desired in the foot supports 19 at any given time. Locking knobs 28 are provided to fix the selected position of each foot support 19 on the respective sockets 61.

Brackets 60 are elevationally supported on the bed frame 10 by two longitudinal parallelogram arms 62 and 63 (FIGS.11 and 13). The arms 62 and 63 extend directly alongside bed frame 10 and overlap the outer supports 15. Elevational movement of the brackets 60 is provided by a second motorized actuating assembly 53 in bed frame 10 (FIGS. 6 and 7). A bell crank 64 at the right hand side of the bed (FIGS. 9 and 11) is connected across the underside of bed frame 10 by a transverse shaft 65. The opposite end of shaft 65 is fixed to a complementary crank arm 66, which pivots in unison with the bell crank 64. The outer ends of bell crank 64 and crank arm 66 are pivotally connected to a link 67 that extends to an upper pivot connection at 68, where each parallelogram arm 63 is connected to the respective bracket 60.

Power is transmitted from the motorized actuating assembly 53 to the bell crank 64 by means of a reciprocating bar 70 whose rearward end is connected to the jack shaft of the motor and whose front end is pivotally connected to the bell crank 64 at 71. Brackets 60 are shown in their fully-raised positions in FIGS. 9, 11 and 13. The brackets 60 will be raised or lowered relative to the bed frame 10 in response to reciprocation of bar 70. Raising or lowering brackets 60 elevationally positions the foot supports 19 relative to bed frame 10 and relative to the mattress assemblies 12, 13 carried on it.

The elevationally movable outer supports 15 that carry the extended lower mattress assembly 13 are rigidly connected by a transverse brace 31 (FIG. 10) and are movably guided by an inner pair of parallelogram arms 72 and 73 overlapped by the parallelogram arms 62 and 63 that support brackets 60 (See FIGS. 12 and 14). The rearward ends of arms 72 and 73 are pivoted to the bed frame 10, and their front ends are pivoted to the outer supports 15 at each side of the bed. Since the outer supports 15 are rigidly joined to one another by a brace 31, it is important to assure that they be moved elevationally in unison, whether such movement is imparted through a powered mechanism or by manual lifting effort. This is accomplished by interconnecting the parallelogram arms 72 across a transverse shaft 75 arranged across the upper front section of bed frame 10. Shaft 75 is a central shaft rotatably mounted within the tubular shaft 57 that supports the bed frame 10 on the lift assembly 14.

Springs 76 are connected between bed frame 10 and the rearward end of each parallelogram arm 73 to counterbalance the weight of the cantilevered lower mattress assembly 13 while it is extended forwardly from the outer supports 15. Since the weight of the mattress assembly 13 is essentially neutralized by operation of the springs 76, the cantilevered lower mattress assembly 13 can be readily raised or lowered by manual pressure.

Brackets 60 and outer supports 15 at each side of the bed are interconnected by means of an overcenter linkage 77 (FIGS. 12 and 14). When released, the linkages 77 fold to permit the lower mattress assembly 13 to move downwardly until the bottom edge of the supporting parallelogram arms 73 engage the transverse shaft 65 that interconnects the bell crank 64 and crank arm 66. This defines the lowermost position of the outer supports 15 relative to bed frame 10, which is the elevational position at which the tray 30 of the lower mattress assembly 13 can be moved in or out relative to the cavity presented within the bed frame 10 by sliding along the previously described floor 17. After the lower mattress assembly 13 is manually raised to an elevation at which the spring-biased overcenter linkage 77 reaches a locking position—which defines the maximum elevational height of the outer supports 15 relative to bracket 60 —the locked linkages 77 maintain it in that relative elevation until they are released. Release is manually controlled by operation of one or both levers 78 that are conjointly moved through a connecting transverse shaft pivoted across the outer supports 15. Each lever 78 has a section that abuts the front edge of the overcenter linkage 77 to break the overcenter relationship between the elements of the linkage and free the outer supports 15 for elevational adjustment relative to the brackets 60.

When the overcenter linkages 77 are locked in position, the outer supports 15 and the lower mattress assembly 13 (when cantilevered from the outer supports 15) will be "piggybacked" on the motorized elevational actuation assembly that controls the position of bracket 60. This permits the user of the bed to selectively move the lower mattress assembly 13 independently of foot supports 19 by manual pressure, or in unison with them by motor power through operation of the second actuating assembly 53. When the linkages 77 are locked, the motorized assembly 53 will conjointly move the brackets 60 and the outer supports 15.

The above apparatus provides a highly versatile and adjustable bed for birthing and gynecology purposes. When fitted with an optional headboard, the bed is capable of being used in an extended horizontal or coplanar configuration just as any normal bed. It is readily adjustable elevationally by the left mechanisms at each side, which are designed to leave the center of the bed unobstructed at all elevations of the mattress assemblies relative to the floor. The backrest and seat can be pivoted upwardly or downwardly by a motor assembly 55 mounted within the bed frame 10 at the side opposite to the motor assembly 53 at the head end of the bed frame 10. As previously described, one can manually move the lower mattress assembly 13 to the position where it is retractable within the interior of bed frame 10 by either powering the outer supports 15 while locked to the brackets 60 for foot supports 19, or by manually pushing it downwardly after releasing the overcenter linkages 77. The person using the bed has an option of maintaining the foot supports 19 at the elevational level of the lower mattress assembly 13, or can move either independently of the other after releasing the overcenter linkages 77.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. An elevationally adjustable bed, comprising:

a rigid bed frame having opposed sides;

a floor-supported base located elevationally beneath the bed frame;

longitudinal mattress means on the bed frame for supporting the body of a user; and lift means operably connected between the bed frame and the base for elevationally raising or lowering the bed frame relative to the base, the lift means partially overlapping the bed frame in a nesting relationship;

the lift means comprising:

a base transport movably mounted on the base;

parallel arms positioned in pairs alongside the respective sides of the bed frame, the paired arms extending respectively from two lower horizontal pivot connections on the base transport to two upper horizontal pivot connections;

guide means on the base operably mounting the base transport for horizontal longitudinal movement relative to the base; and restraining means operably connected between the base and the arms for causing the arms to move angularly relative to the base about their two lower horizontal pivot connections in response to horizontal longitudinal movement of the base transport relative to the base.

2. The bed of claim 1 wherein the base comprises a pair of transversely spaced longitudinal rails;

the lift means being located inwardly adjacent to the respective rails at opposite sides of the base.

3. The bed of claim 1 wherein the base comprises a pair of transversely spaced longitudinal rails;

the lift means being located inwardly adjacent to the respective rails at opposite sides of the base, the lift means being partially overlapped by the rails of the base in a nesting arrangement that permits the lift means to be moved elevationally within the space transversely separating the rails.

4. The bed of claim 1 wherein the bed frame is pivotally connected to the lift means about a transverse horizontal axis;

and adjustable means operably connected between the lift means and the bed frame for selectively varying the angular position of the bed frame relative to the base about the transverse horizontal axis.

5. The bed of claim 1 wherein the mattress means comprises:

a longitudinal upper mattress assembly overlying the bed frame and mounted to it, the upper mattress assembly being adapted to be engaged by the head and torso of the user;

a separate lower mattress assembly, the lower mattress assembly being adapted to be engaged by the lower extremities of a user;

and wherein the bed further comprises:

guide means on the bed frame for selectively positioning the lower mattress assembly in a retracted position recessed elevationally beneath the upper mattress assembly.

6. The bed of claim 1, wherein the mattress means comprises:

a longitudinal upper mattress assembly overlying the bed frame and mounted to it, the upper mattress assembly being adapted to be engaged by the head and torso of the user;

a separate lower mattress assembly, the lower mattress assembly being adapted to be engaged by the lower extremities of a user;

and wherein the bed further comprises:

guide means on the bed frame for selectively positioning the lower mattress assembly in a retracted position recessed elevationally beneath the upper mattress assembly; and outer support means mounted to the bed frame, the outer support means being selectively engageable by the lower mattress assembly as it is extended outwardly from its retracted position for attaching the lower mattress assembly solely to the outer support means in a cantilevered position extending longitudinally outward from the bed frame.

7. The bed of claim 1 wherein the mattress means comprises:

a longitudinal upper mattress assembly overlying the bed frame and mounted to it, the upper mattress assembly being adapted to be engaged by the head and torso of the user;

a separate lower mattress assembly, the lower mattress assembly being adapted to be engaged by the lower extremities of a user;

and wherein the bed further comprises:

guide means on the bed frame for selectively positioning the lower mattress assembly in a retracted position recessed elevationally beneath the upper mattress assembly;

outer support means mounted to the bed frame for elevational movement relative to the bed frame, the outer support means being selectively engageable by the lower mattress assembly as it is extended outwardly from its retracted position for attaching the lower mattress assembly solely to the outer support means in a cantilevered position extending outward from the bed frame longitudinally adjacent to the upper mattress assembly; and actuating means operably connected between the bed frame and the outer support means for elevationally positioning the outer support means relative to the bed frame.

8. The bed of claim 7 wherein the actuating means comprises:

a pair of brackets positioned respectively alongside the outer support means at opposite sides of the bed frame, the brackets being adapted to carry outboard foot supports that extend outward from the bed frame from locations adjacent to the upper mattress assembly;

an actuator on the bed frame operably connected to the pair of brackets for selectively raising or lowering the brackets relative to the bed frame;

and releasable means operably connected between the outer support means and the brackets for selectively (1) fixing the outer support means to the brackets for raising or lowering the outer support means conjointly with the brackets or (2) releasing the outer support means for elevational movement relative to the bed frame independently of the brackets.

9. The bed of claim 1 wherein the mattress means comprises:

a longitudinal upper mattress assembly overlying the bed frame and mounted to it for engagement by the head and torso of a user, the upper mattress assembly including a back rest having a head end, and a seat having a front edge;

the back rest being pivotally mounted about a transverse axis across the bed frame for permitting its head end to be raised or lowered relative to the bed frame;

the seat being pivotally mounted about a transverse axis across the bed frame for permitting its front edge to be raised or lowered relative to the bed frame; and the back rest and seat of the upper mattress assembly each having side edges that transversely overlap the lift means at opposite sides of the bed frame.

10. The bed of claim 1 wherein the mattress means comprises:

a longitudinal upper mattress assembly overlying the bed frame and mounted to it for engagement by the head and torso of a user, the upper mattress assembly including a back rest having a head end, and a seat having a front edge;

the back rest being pivotally mounted about a transverse axis across the bed frame for permitting its head end to be raised or lowered relative to the bed frame;

the seat being pivotally mounted about a transverse axis across the bed frame for permitting its front edge to be raised or lowered relative to the bed frame;

the back rest and seat of the upper mattress assembly each having side edges that transversely overlap the lift means at opposite sides of the bed frame; and actuating means operably connected between the bed frame and the upper mattress assembly for selectively moving the back rest and seat relative to the bed frame and to each other.

11. An adjustable bed for movably supporting a user, comprising:

a rigid bed frame having opposed sides;

a longitudinal upper mattress assembly overlying the bed frame and mounted to it, the upper mattress assembly being adapted to be engaged by the head and torso of a user;

a separate lower mattress assembly, the lower mattress assembly being adapted to be engaged by the lower extremities of a user;

guide means on the bed frame for selectively positioning the lower mattress assembly in a retracted position recessed elevationally beneath the upper mattress assembly;

outer support means mounted to opposite sides of the bed frame for elevational movement relative to the bed frame, the outer support means being selectively engageable by the lower mattress assembly as it is extended outwardly from its retracted position for attaching the lower mattress assembly solely to the outer support means in a cantilevered position extending outward from the bed frame longitudinally adjacent to the upper mattress assembly;

a pair of foot supports mounted respectively to opposite sides of the bed frame for engagement by a person on the upper mattress assembly; and releasable means operably connected between the foot supports and the outer support means for selectively causing them to be elevationally movable in unison relative to the bed frame.

12. The bed of claim 11, further comprising:

actuating means operably connected between the bed frame and the outer support means for selectively positioning the outer support means elevationally relative to the bed frame.

13. The bed of claim 11, further comprising:

a pair of foot supports mounted respectively to opposite sides of the bed frame for engagement by a person on the upper mattress assembly;

each foot support being pivotally mounted relative to the bed frame for movement between a lowered position extending longitudinally outward and a raised position in which it extends outwardly in an orientation directed angularly upward from its lowered position.

14. The bed of claim 11, further comprising:

a pair of foot supports mounted respectively to opposite sides of the bed frame for engagement by a person on the upper mattress assembly;

each foot support being pivotally mounted relative to the bed frame for movement between a lowered position extending longitudinally outward and a raised position in which it extends outwardly in an orientation directed angularly upward from its lowered position;

the transverse width of the lower mattress assembly being less than that of the upper mattress assembly;

the foot supports each including a longitudinally tapered surface area at one side thereof which merges the widths of the upper and lower mattress assemblies while in its lowered position and a recessed surface at a second side thereof for engagement by a foot of a person on the upper mattress assembly while in its raised position.

15. The bed of claim 11, further comprising:

a pair of foot supports mounted respectively to opposite sides of the bed frame for engagement by a person on the upper mattress assembly;

bracket means movably mounted on the bed frame for elevationally moving the foot supports relative to the bed frame; and actuating means operably connected between the bed frame and the bracket means for selectively positioning the bracket means elevationally relative to the bed frame.

16. The bed of claim 11 wherein the upper mattress assembly includes:

a backrest having a head end, the backrest being pivotally mounted about a transverse axis across the bed frame for permitting its head end to be raised or lowered relative to the bed frame.

17. The bed of claim 11 wherein the upper mattress assembly includes:

a backrest;

a seat;

the backrest having a head end, the backrest being pivotally mounted about a transverse axis across the bed frame for permitting its head end to be raised or lowered relative to the bed frame;

the seat having a front edge, the seat being pivotally mounted about a transverse axis across the bed frame for permitting its front edge to be raised or lowered relative to the bed frame.

18. The bed of claim 11 wherein the upper mattress assembly includes:

a backrest;

a seat;

the backrest having a head end, the backrest being pivotally mounted about a transverse axis across the bed frame for permitting its head end to be raised or lowered relative to the bed frame;

the seat having a front edge, the seat being pivotally mounted about the transverse axis across the bed frame for permitting its front edge to be raised or lowered relative to the bed frame; and actuating means operably connected between the bed frame and both the backrest and the seat for selectively moving the backrest and seat relative to the bed frame.

19. The bed of claim 11, further comprising:

a floor-supported base; and lift means operably connected between the bed frame and the base for elevationally raising or lowering the bed frame relative to the base.

20. The bed of claim 19 further comprising:

actuating means operably connected between the base and the lift means for selectively moving the lift means relative to the base.

21. The bed of claim 19, wherein the lift means comprises a pair of transversely spaced mechanisms located outwardly adjacent to the respective sides of the bed frame;

the sides of the bed frame being partially overlapped by the pair of transversely spaced mechanisms in a nesting relationship that permits the bed frame to move elevationally within the space transversely separating them.

22. The bed of claim 21, wherein;

the base comprises a pair of transversely spaced longitudinal rails;

the pair of transversely spaced mechanisms being located inwardly adjacent to the respective rails at opposite sides of the base in a nesting arrangement that permits them to move within the space transversely separating the rails.

23. An adjustable bed, comprising:

a rigid bed frame having opposed sides;

a longitudinal upper mattress assembly overlying the bed frame and mounted to it, the upper mattress assembly having a top surface area extending between a head end and a front edge, the top surface area being adapted to support the head and torso of a user;

a separate lower mattress assembly, the lower mattress assembly having a top surface area adapted to support the lower extremities of a user;

guide means on the bed frame for selectively engaging the lower mattress assembly as it is moved longitudinally relative to the bed frame to or from a retracted position that is elevationally beneath the upper mattress assembly;

a pair of elevationally movable outer supports respectively mounted to the sides of the bed frame at locations longitudinally adjacent to the front edge of the upper mattress assembly;

actuating means operably connected between the bed frame and the outer supports for moving them elevationally in unison relative to the bed frame;

attachment means on each outer support for selectively engaging the lower mattress assembly in a cantilevered position that protrudes longitudinally outward from the bed frame;

a pair of foot supports;

movable bracket means mounted to the bed frame for adjustably holding the foot supports for engagement by the feet of a user while on the upper mattress assembly;

the actuating means including movable means mounted to the bed frame for elevationally positioning the bracket means relative to the bed frame; and releasable means operably connected between the bracket means and the outer support means for selectively causing them to be elevationally movable in unison relative to the bed frame.

24. The bed of claim 23, wherein the actuating means further comprises:

a pair of foot supports;

movable bracket means mounted to the bed frame for adjustable holding the foot supports for engagement by the feet of a user on the upper mattress assembly.

25. The bed of claim 23, further comprising:

a floor-supported base; and lift means operable connecting the base and the bed frame for selectively raising or lowering the bed frame and the upper and lower mattress assemblies relative to the base throughout the elevational range of motion of the lift means without impeding movement of the lower mattress assembly between its retracted position engaged by the guide means and its cantilevered position engaged by the attachment means.

26. The bed of claim 25, wherein the lift means comprises:

a pair of transversely spaced mechanisms arranged in parallel vertical positions across the base and connected to the respective sides of the bed frame in a partially overlapping relationship for selectively raising or lowering the bed frame relative to the base while permitting it to nest within the transversely spaced mechanisms.

27. The bed of claim 23, further comprising:

a pair of foot supports mounted respectively to opposite sides of the bed frame for engagement by a person on the upper mattress assembly;

each foot support being pivotally mounted relative to the bed frame for movement between a lowered position extending longitudinally outward and a raised position in which it extends outwardly in an orientation directed angularly upward from its lowered position;

the transverse width of the lower mattress assembly being less than that of the upper mattress assembly;

the foot supports each including a longitudinally tapered surface area at one side there of which merges the widths of the upper and lower mattress assemblies when in its lowered position and a recessed surface at a second side thereof for engagement by the foot of a person on the upper mattress assembly when in its raised position.

28. An elevationally adjustable bed, comprising:

a rigid bed frame having opposed sides;

a floor-supported base located elevationally beneath the bed frame;

longitudinal mattress means on the bed frame for supporting the body of a user; and lift means operably connected between the bed frame and the base for elevationally raising or lowering the bed frame relative to the base, the lift means partially overlapping the bed frame in a nesting relationship;

the lift means comprising:

a base transport movably mounted on the base;

parallel arms positioned in pairs alongside the respective sides of the bed frame, the paired arms extending respectively from two lower horizontal pivot connections on the base transport to two upper horizontal pivot connections;

guide means on the base operably mounting the base transport for horizontal longitudinal movement relative to the base;

restraining means operably connected between the base and the arms for causing the arms to move angularly relative to the base about their two lower horizontal pivot connections in response to horizontal longitudinal movement of the base transport relative to the base;

actuating means operably connected between the base and the base transport for moving the base transport longitudinally relative to the base;

means pivotally suspending the bed frame about a first of the upper horizontal pivot connections on the parallel arms; and adjustable means operably connected between the bed frame and the remaining upper horizontal pivot connection on the parallel arms for selectively fixing the angular position of the bed frame about the first upper horizontal pivot connection on the parallel arms.

29. An adjustable bed for movably supporting a user, comprising:

a rigid bed frame having opposed sides;

a longitudinal upper mattress assembly overlying the bed frame and mounted to it, the upper mattress assembly being adapted to be engaged by the head and torso of a user;

a separate lower mattress assembly, the lower mattress assembly being adapted to be engaged by the lower extremities of a user;

guide means on the bed frame for selectively positioning the lower mattress assembly in a retracted position recessed elevationally beneath the upper mattress assembly;

outer support means mounted to opposite sides of the bed frame for elevational movement relative to the bed frame, the outer support means being selectively engageable by the lower mattress assembly as it is extended outwardly from its retracted position for attaching the lower mattress assembly solely to the outer support means in a cantilevered position extending outward from the bed frame longitudinally adjacent to the upper mattress assembly;

a pair of foot supports mounted respectively to opposite sides of the bed frame for engagement by a person on the upper mattress assembly; and bracket means movably mounted on the bed frame for elevationally moving the foot supports relative to the bed frame; and actuating means operably connected between the bed frame and the bracket means for selectively positioning the bracket means elevationally relative to the bed frame;

releasable means operably connected between the foot supports and the outer support means for selectively causing them to be elevationally movable in unison relative to the bed frame.

* * * * *